United States Patent [19]

Watanabe

[11] 4,405,124

[45] Sep. 20, 1983

[54] TAG FEED MECHANISM

[75] Inventor: Michitoshi Watanabe, Nagoya, Japan

[73] Assignee: Tomoe Special Machine Co., Ltd., Nagoya, Japan

[21] Appl. No.: 331,784

[22] Filed: Dec. 17, 1981

[51] Int. Cl.[3] ..... B65H 3/24

[52] U.S. Cl. ..... 271/135; 271/138; 271/143

[58] Field of Search ..... 271/131, 137, 138, 139, 271/140, 143, 135

[56] References Cited

U.S. PATENT DOCUMENTS 1,433,873 10/1922 Cogswell ..... 271/137
3,285,604 11/1966 Parker ..... 271/138 X

FOREIGN PATENT DOCUMENTS 771119 3/1957 United Kingdom ..... 271/143

*Primary Examiner*—Richard A. Schacher
*Attorney, Agent, or Firm*—Wender, Murase & White

[57] ABSTRACT

Apparatus for feeding tags from a tag hopper to a tag attaching station includes a spring biased push member having a notched front end for cooperation with a downwardly inclined shutter at the entry of the tag hopper for engaging the lowermost tag and pushing the same to the tag attaching station. A second shutter at the exit of the tag hopper contains a resilient finger for exerting a drag force against any tags above the lowermost tag so as to retain all but the lowermost tag in the hopper during a feed stroke.

15 Claims, 10 Drawing Figures

TAG FEED MECHANISM

BACKGROUND OF THE INVENTION

1. Field of the Invention

The present invention relates generally to tag feed mechanisms, and more particularly, to an apparatus for feeding relatively thin tags, one at a time, from a tag hopper to a tag attaching station.

2. Description of the Prior Art

In my copending U.S. patent application, Ser. No. 206,613, filed Nov. 13, 1980, there is disclosed and described a tag attaching machine which enables the rapid and semiautomatic feeding of thin tags, such as cardboard price tags, from a stacked supply to an attaching station and for sewing the tag to a garment or other article. This machine has achieved considerable commercial success since it permits the rapid attachment of price tags and other identifying tags to articles of all types by means of relatively inexpensive thread. Furthermore, the tag is attached in a manner which avoids damage to even the most delicate of fabrics, as opposed to the results sometimes obtained by use of more expensive, nylon fasteners.

In many applications, the tags to be attached by such machine are extremely thin, making them difficult to feed, one at a time, from a stacked supply at a tag hopper to the attaching station. While the prior art tag feeding mechanisms have generally served the purpose, it is important that an improved mechanism be available to assure that even the most thin tags may be fed quickly and one at a time to the attaching station without jamming or damaging the tags in any way.

SUMMARY OF THE INVENTION

It is, therefore, an object of the present invention to feed relatively thin tags from a stacked array to a tag attaching station individually and without causing jams or damage to the tags.

A further object of this invention is to construct a tag feed mechanism in which any tags inadvertently displaced from a stacked supply during the feed of an individual tag are automatically moved back into the stack before the next tag feed sequence is initiated.

Another object of this invention is to construct a tag feed mechanism with a push member having a notched leading edge for cooperation with a cam on a shutter element to assure engagement with and feed of only the lowermost tag in a stacked tag array.

The present invention exhibits a number of important advantages over the prior art in that tags of very thin dimensions may be accurately and conveniently fed, one at a time, from a stacked array to a tag attaching station, that tags inadvertently displaced from the stacked array during a tag feed sequence will be restacked prior to the initiation of the next sequence, and that pickup of only the lowermost tag in the stack is more effectively assured.

The present invention is summarized as a tag feed mechanism having a spring biased pusher element with a notched leading edge for cooperation with a cammed shutter element placed at the entry of a tag hopper to assure that the edge of only the lowermost tag in the hopper is engaged by the pusher and moved out of the hopper toward an attaching station. The present invention is further summarized as a tag feed mechanism having at the exit of the tag hopper a resilient finger for engaging any tag above the lowermost tag in the hopper and exerting a drag force thereon so as to preclude displacement of all tags other than the lowermost tag during a feed sequence.

Other objects and advantages of the present invention will be become apparent from the following description of the preferred embodiment when taken in conjunction with the accompanying drawings.

DESCRIPTION OF THE PREFERRED EMBODIMENT

Figure 1:
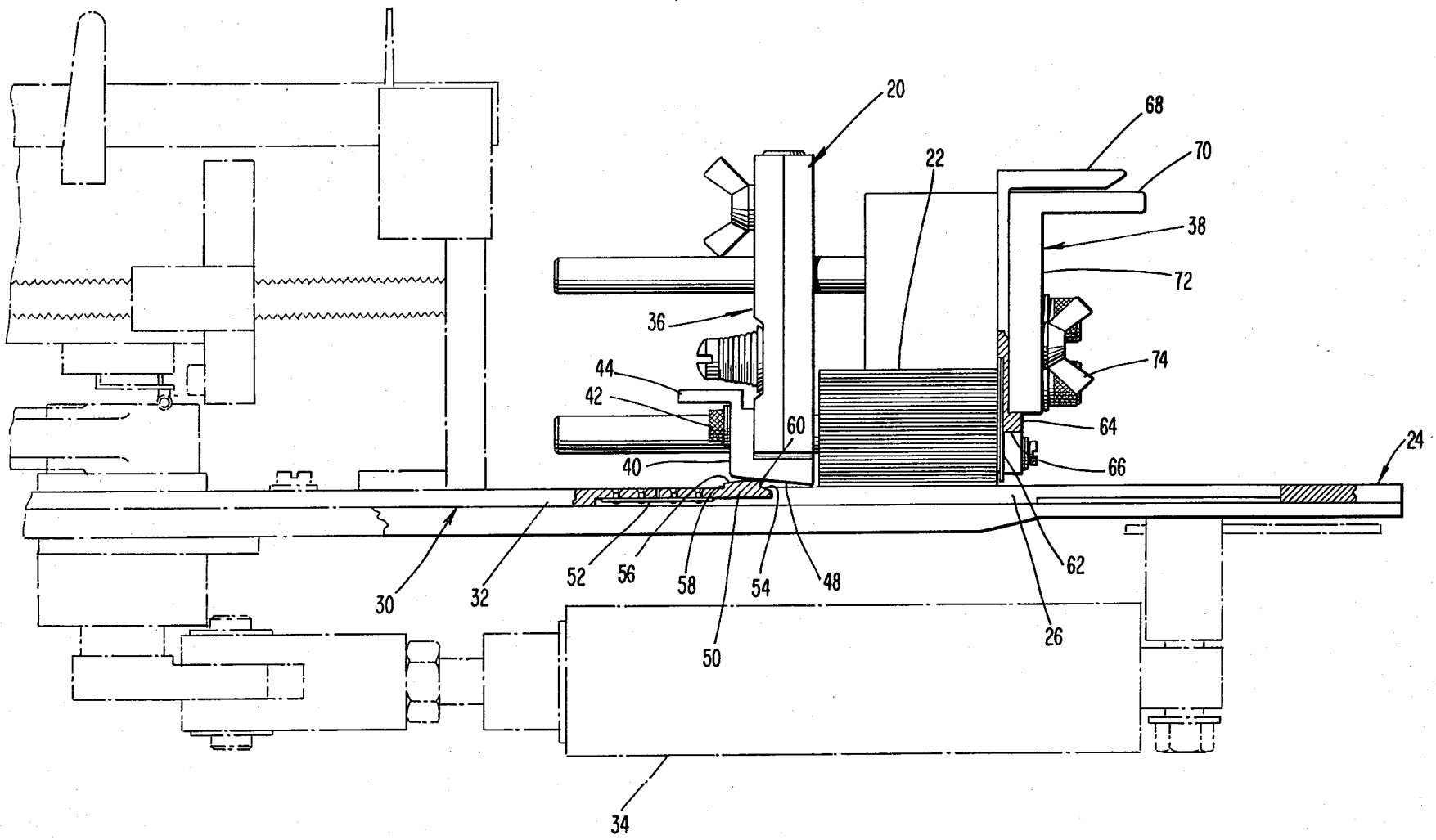
FIG. 1 is a front elevational view, with parts shown in phantom, of a preferred embodiment of a tag feed mechanism in accordance with the present invention.
Figure 2:
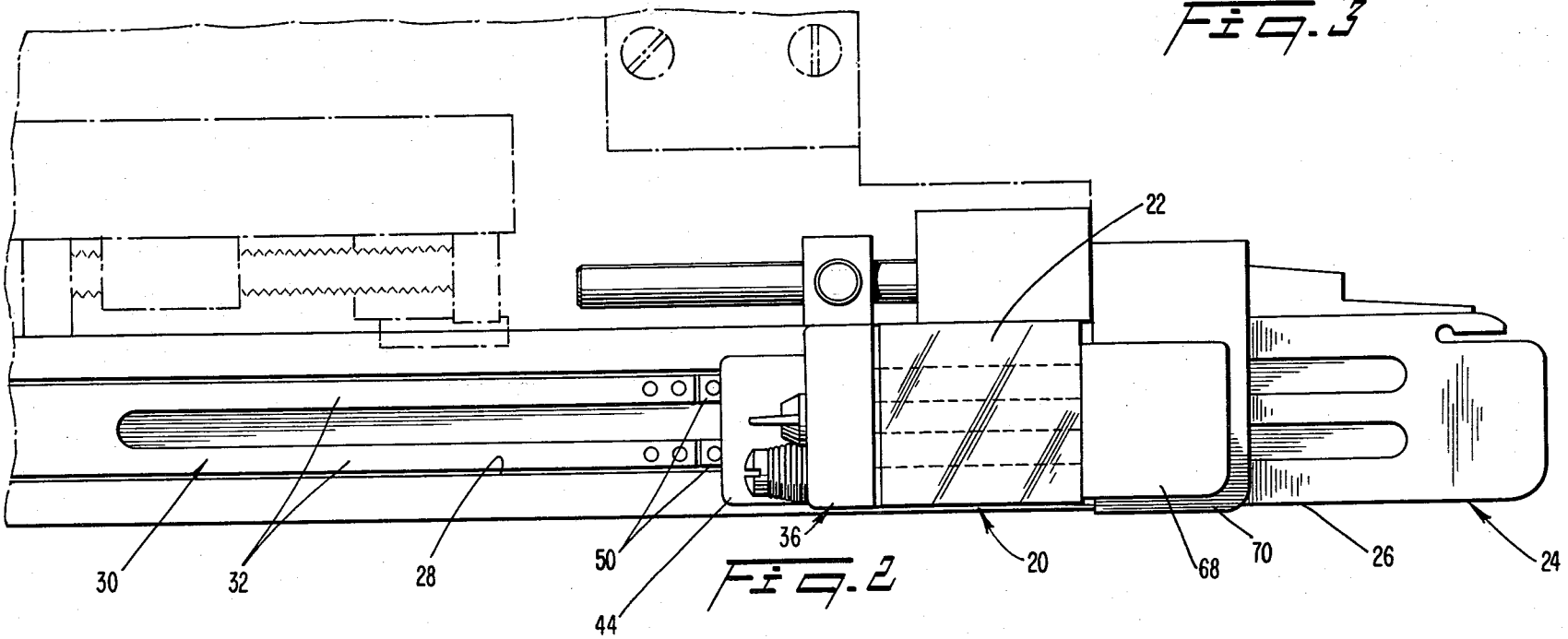
FIG. 2 is a top plan view of the tag feed mechanism of FIG. 1 in accordance with the present invention.

The present invention is embodied in a tag feed mechanism identified generally by the number 20. The tag feed mechanism is particularly well suited for use in a tag attaching machine of the type illustrated and described in my copending application Ser. No. 206,613, filed Nov. 13, 1980, which is incorporated herein by reference. As shown in FIGS. 1 and 2, the tag feed mechanism 20 is adapted to hold a supply of individual, flat tags in a stacked array 22 for transport, one at a time, to a tag attaching station 24.

As described in greater detail in my copending application, the tag feed mechanism is mounted above a base or support platform 26 having a channel or elongated slot 28 for receiving a tuning fork-like push member 30 having a pair of tines 32. The push member 30 is adapted to be pivotally attached to any suitable actuating mechanism for causing the push member to be rectilinearly moved from left to right and then back to the left as visualized in FIG. 2. The actuating mechanism for push member 30 may be of any suitable type, such as a pneumatic cylinder 34 shown in FIG. 1.

The tag feed mechanism 20 according to the present invention includes an upstream wall assembly 36 and a downstream wall assembly 38 forming the boundaries for the stacked array 22. Preferably, one or both of walls 36 and 38 may be adjusted along the horizontal to accommodate for tags of different lengths.

Walls 36 and 38 are mounted at a distance above the tag platform 26 so as to permit the tines 32 of the push member 30 to pass thereunder during a tag transport sequence.

A generally L-shaped shutter element 40 is attached to wall assembly 36 by means of a knurled bolt 42. A handle 44 protrudes from the upper end of the shutter 40 to permit the shutter element 40 to be adjusted in height after the bolt 42 is loosened. Once the desired height adjustment has been made, bolt 42 may be retightened so as to maintain the shutter in the proper position.

As can be appreciated from FIG. 1, the bottom of the shutter element 40 is provided with an inclined surface 48 which serves as a camming surface for a pair of push elements 50 which are resiliently connected by flat spring members 52 to the distal ends of each of the two tines 32 of push member 30.

The pusher elements 50 have a generally flat bottom surface and are provided with a notch 54 in the front surface. The top surface of the front portion of each of the elements 50 is inclined slightly away from shutter element 40 and is slightly convex as shown. The top surface also defines a step 58 for restacking the tags after a tag transport sequence, as will be described in greater detail hereinbelow.

As can be appreciated from the drawings, the upper surface of the notch 54 meets the top surface 56 at a relatively sharp edge 60 with the edge 60 and top surface 56 cooperating with the camming surface 48 of shutter 40 to cause the pusher elements to be resiliently displaced downwardly during a tag movement sequence.

At the downstream or exit side of the stacked array 22, a resilient finger in the form of a flat spring member 62 is vertically mounted on wall assembly 38. The width of the spring 62 is such that the same fits between the tines 32 when the push member 30 is extended to the right as visualized in FIG. 1. The spring 62 is attached to the bottom end of a generally L-shaped wall 64 which has a notch 66 cut centrally therethrough. The notch 66 permits spring 62 to be flexed or bent toward the right as visualized in FIG. 1 in the event that more than one tag is moved out of the stacked array.

Figure 6:
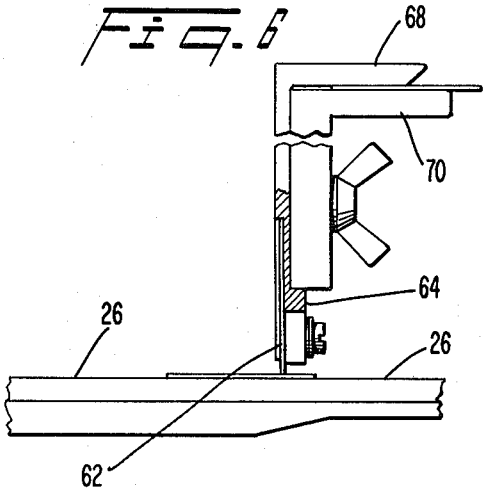

The bottom edge of spring 62 is preferably disposed above the platform 26 by a space equal to the thickness of the particular tags to be fed from the array to the attaching station. To facilitate the adjustment and setting of such spacing, the L-shaped wall 64 is provided with a horizontal leg 68 which cooperates with a similar horizontal leg 70 extending from fixed wall 72 of the wall assembly 38. By loosening of the nut 74, wall 64 may be moved vertically with respect to wall 72. By placing a tag between legs 68 and 70, as shown in FIG. 6, the spacing between the bottom edge of spring 62 and the top of platform 26 is precisely set to match the dimension of the tag being fed. The nut 74 then can be firmly tightened so as to maintain the proper spacing throughout the tag feeding sequence.

Figure 5:
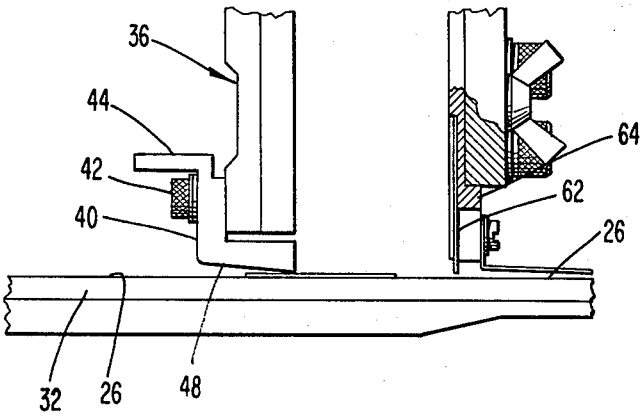
FIGS. 5–10 are front elevational views, with parts broken away and in section of the tag hopper portion of the tag feed mechanism of FIG. 1 according to the present invention.

In like manner, the shutter 40 may be adjusted by placing a tag directly between the bottom of the shutter and the platform 26 as shown in FIG. 5. Handle 44 then may be manipulated to place the shutter 40 in contact with the tag, and bolt 42 then may be retightened to maintain the desired spacing.

Figure 3:
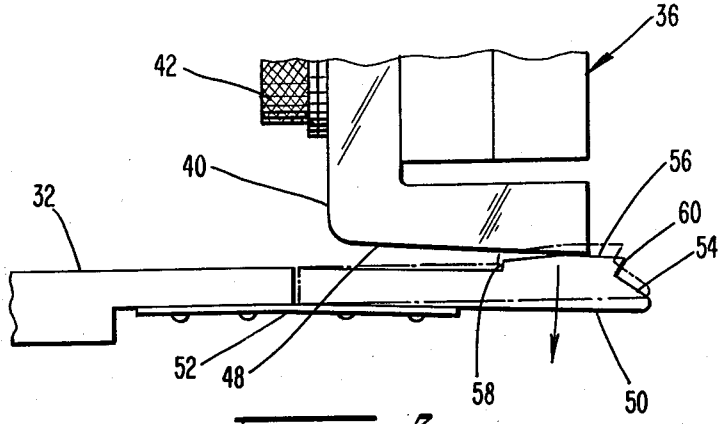
FIG. 3 is a front elevational view of a detail of the spring biased pusher element and cammed shutter of the tag feed mechanism of FIG. 1 according to the present invention.

Referring to FIG. 3, it can be appreciated that as the push member 30 is moved toward the right, the tines 32 move the pusher elements 50 into engagement with the camming surface 48 of shutter 40. The interaction between the pusher elements 50 and the camming surface 48 causes the pusher elements to be displaced downwardly, as shown, against the resilient biasing force of spring 52. Since the lowermost edge of the camming surface 48 is spaced above the tag support platform 26 by the precise thickness of the tag being moved, the relatively sharp upper edge 60 of the notched front of the pusher lements 50 contacts the stacked array at precisely the point of separation between the lowermost tag and the next lowermost tag in the stack.

The inclined or notched front face 54 of the pusher elements then causes the lowermost tag to be pulled down away from the stack as it is pushed forward toward the tag attaching station. As a result, only a single tag will be moved out of the stacked array, even where the tags are of very thin construction.

Figure 4:
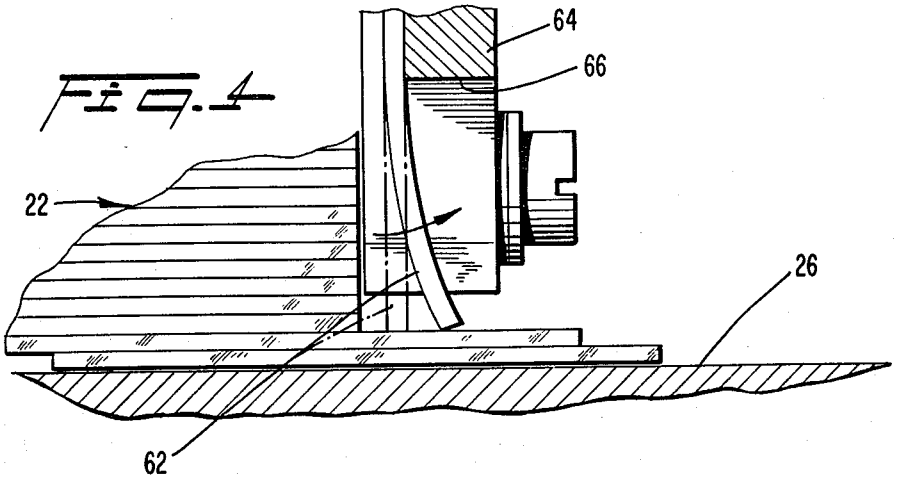
FIG. 4 is a front elevational view of a detail of the resilient drag finger at the exit of the tag hopper of the tag feed mechanism of FIG. 1 according to the present invention.

Despite the foregoing advantageous operation of the pusher elements constructed in accordance with the present invention, there may arise certain occasions where a second tag sticks to the bottom tag and starts to move toward the tag attaching station along with the intended bottom tag. As shown in FIG. 4, such undesired action causes the second lowest tag to engage the bottom of the spring 62 causing the same to be bent to the right. The spring thus exerts a drag force on the next to the bottom tag whereupon the same is prevented from advancing all the way towards the tag attaching station.

Figure 7:
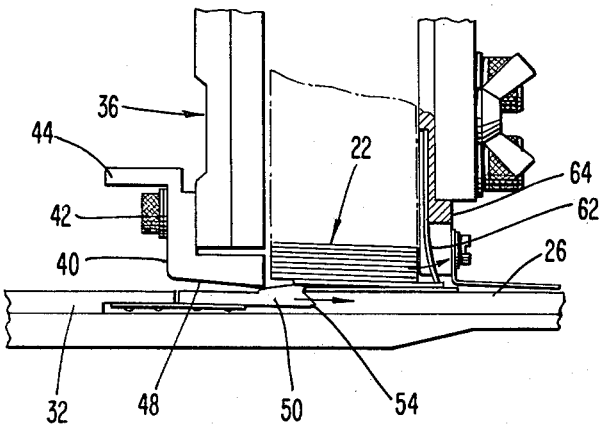
Figure 8:
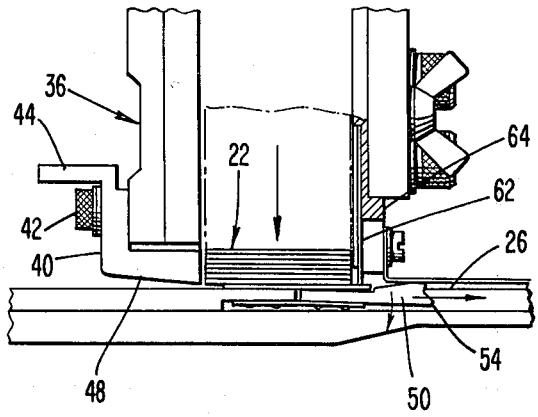
Figure 9:
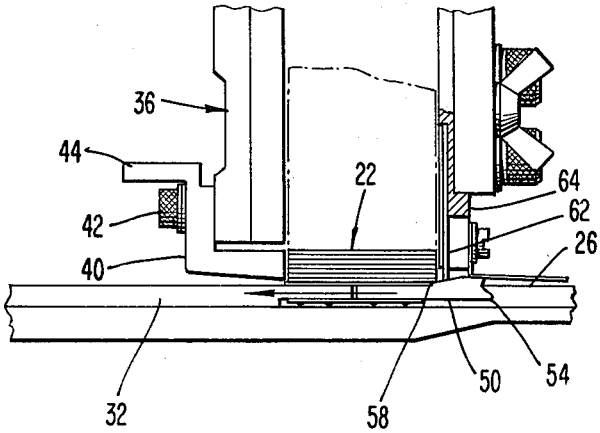
Figure 10:
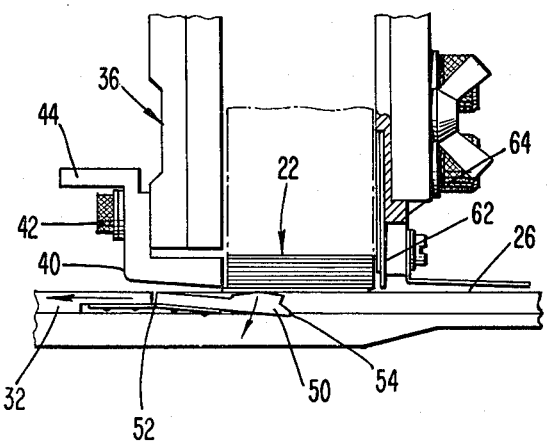

The sequence of events described above is illustrated in FIG. 7. In FIG. 8, push member 30 has advanced to the right to the point where the front portion of each of the pusher elements 50 has passed under spring 62 at the exit of the stacked tag array. Upon return of the push member 30 to the left, as shown in FIG. 9, the step or shoulder 58 formed in the upper surface of the pusher elements 50 will engage the inadvertently displaced lowermost tag, causing the same to be returned back to a nested position. As shown in FIG. 9, the tag may extend slightly to the left of the remainder of the stacked array; however, this will cause no difficulty and may enhance the positive feed of only a single tag during the next tag feeding sequence.

As can be appreciated from the foregoing, the tag feed mechanism according to the present invention provides a number of significant advantages over the prior art and results in the smooth and rapid advancement of tags, one at a time, from a stacked supply to a separate tag attaching station without resulting in fouling or damage to the tags. The above advantages are true even in situations where the tags are of extremely thin construction, thus permitting the use of any desired variety of tag of any desired dimension.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. A tag feed mechanism for feeding tags one at a time from a stacked tag supply to a tag attaching station, comprising:

a base;

a tag push member slidably disposed on said base for engaging and moving a tag from the tag supply to the tag attaching station;

a pusher element resiliently coupled to the distal end of said tag push member; and a shutter element disposed upstream of the stacked tag supply and having a bottom surface disposed at a distance above said base equal to the thickness of an individual tag in said stacked tag supply, the bottom surface of said shutter element cooperating with said pusher element for displacing said pusher element from a rest position to a tag pickup position as said tag push member moves from the tag supply to the tag attaching station, whereby only a single tag is moved out of the stacked tag supply.

2. The invention as recited in claim 1 wherein the bottom surface of said shutter element is inclined downwardly in a direction towards the stacked tag supply; and wherein the distance of the lowermost point of said inclined bottom surface above said base is equal to the thickness of an individual tag in said stacked tag supply.

3. The invention as recited in claim 1 wherein said pusher element has a notched front surface.

4. The invention as recited in claim 3 wherein the notched front surface of said pusher element has an upper edge at the terminus of two exterior surfaces of the pusher element disposed at less than a right angle relative each other.

5. The invention as recited in claim 1 wherein the upper surface of said pusher element is generally downwardly inclined in a direction toward the distal end of said push member.

6. The invention as recited in claim 5 wherein said upper surface of said pusher element is convex.

7. The invention as recited in claim 5 wherein said upper surface of said pusher element defines a step for engagement with a second tag in the tag supply upon return of said push member toward its initial position following the movement by said push member of a first tag in the tag supply to the tag attaching station.

8. The invention as recited in claim 1 wherein said push member comprises a tuning fork-like member having two tines; and wherein each of a pair of said pusher elements is resiliently coupled to a respective one of said tines.

9. The invention as recited in claim 1 wherein said pusher element is connected to said push member by a generally flat spring.

10. The invention as recited in claim 1 further including a resilient finger mounted above said base downstream of said stacked tag supply, said resilient finger being spaced above said base by a distance sufficient to permit only a single tag to move thereunder without resistance.

11. The invention as recited in claim 10 wherein said resilient finger comprises a generally flat spring disposed vertically above said base.

12. The invention as recited in claim 10 wherein said resilient finger is adjustable vertically to accommodate tags of different thicknesses.

13. The invention as recited in claim 1 wherein said shutter element is adjustable vertically to accommodate tags of different thicknesses.

14. A tag feed mechanism for feeding tags one at a time from a stacked tag supply to a tag attaching station, comprising:

a base;

a tag push member slidably disposed on said base for engaging and moving a tag from the tag supply to the tag attaching station;

a shutter element disposed adjacent the upstream side of the stacked tag supply and having a camming surface along at least a portion of the bottom of said element, the camming surface of said shutter element being spaced above said base by the thickness of an individual tag;

a pusher element resiliently coupled to the distal end of said tag push member for movement thereby under said shutter, said pusher element having a notched front surface for engagement with the lowermost tag in the stacked tag supply, an upper edge of said notched front surface cooperating with said camming surface of said shutter element to cause displacement of said pusher element relative said push member; and a resilient finger mounted vertically adjacent the downstream side of the stacked tag supply, the lower edge of said finger being spaced above said base by the thickness of an individual tag so as to exert a resistance against movement out of said stacked tag supply of any tag other than the lowermost tag.

15. The invention as recited in claim 14 wherein the upper surface of said pusher element defines a step to engage the lowermost tag remaining in the tag supply if displaced toward the tag attaching station and to return such tag to the stacked tag supply upon return of the pusher element to its initial position following a previous tag moving sequence.

* * * * *